US006387473B1

(12) United States Patent
Sismondi et al.

(10) Patent No.: US 6,387,473 B1
(45) Date of Patent: May 14, 2002

(54) RECEIVING SHEET FOR INK-JET PRINTING COMPRISING A SURFACTANT COMBINATION

(75) Inventors: Alain Dominique Sismondi, Nice (FR); Stefania Ghirardo; Giuseppe Loviglio, both of Savona (IT)

(73) Assignee: Ferrania S.p.A., Ferrania (IT)

( * ) Notice: Subject to any disclaimer, the term of this patent is extended or adjusted under 35 U.S.C. 154(b) by 52 days.

(21) Appl. No.: 09/642,684

(22) Filed: Aug. 21, 2000

(30) Foreign Application Priority Data

Sep. 3, 1999 (IT) ..... SV99A0026

(51) Int. Cl.[7] ..... B41M 5/00

(52) U.S. Cl. ..... 428/195; 428/212; 428/341; 428/342

(58) Field of Search ..... 428/195, 212, 428/341, 342

(56) References Cited

U.S. PATENT DOCUMENTS

| | | | | |
|---|---|---|---|---|
| 4,781,985 A | | 11/1988 | Desjarlais | 428/421 |
| 5,133,803 A | | 7/1992 | Moffatt | 106/25 |
| 5,580,372 A | | 12/1996 | Gino et al. | 106/20 R |
| 5,688,603 A | | 11/1997 | Iqbal et al. | 428/532 |
| 5,705,329 A | * | 1/1998 | Nakajima et al. | 430/536 |
| 5,707,722 A | | 1/1998 | Iqbal et al. | 428/304.4 |
| 5,877,796 A | | 3/1999 | Tsuchiya et al. | 347/105 |

FOREIGN PATENT DOCUMENTS

| | | | |
|---|---|---|---|
| EP | 0761460 | | 6/1999 |
| WO | WO 94/24607 | * | 10/1994 |
| WO | WO 96/16355 | * | 5/1996 |

OTHER PUBLICATIONS

Abstract for Japanese Patent JP08104055; Entitled: Ink Jet Recording Sheet; Inventor: Koyama Toshiya; Filed Oct. 5, 1994, Published Apr. 23, 1996.

Abstract for Japanese Patent Jp07137434; Entitled: Ink Jet Recording Sheet; Inventors: Yoshida Yasumine, Tomimasu Hiroshi, Kojima Osamu; Filed Nov. 19, 1993, Published May 30, 1995.

* cited by examiner

*Primary Examiner*—Bruce H. Hess
(74) *Attorney, Agent, or Firm*—Mark A. Litman & Assoc. P.A.

(57) ABSTRACT

The present invention refers to an ink jet receiving sheet for ink-jet printers comprising a support and at least two ink receiving layers, wherein the ink receiving layer farthest from the support comprises a first non-ionic surfactant having a dynamic surface tension lower than or equal to 27 dyne/cm$^2$, and in that the other ink receiving layer(s) comprise(s) a second non-ionic surfactant having a dynamic surface tension higher than or equal to 30 dyne/cm$^2$. The ink jet receiving sheet of the invention provides minimum bleed, no mottle and good glossiness.

9 Claims, No Drawings

RECEIVING SHEET FOR INK-JET PRINTING COMPRISING A SURFACTANT COMBINATION

FIELD OF THE INVENTION

The invention relates to an ink receptor for ink jet printers, and more particularly, to ink receptor containing a combination of surfactants as additives to reduce formation of mottle and ink bleeding in the resulting image.

BACKGROUND OF THE INVENTION

Ink jet printing has become increasingly popular, particularly for so-called "desk-top publishing", because of its capability to produce small volumes of printed matter from digital input at high throughput speeds. Recent equipment developments have led to the introduction of multi-color ink jet printers that integrate colored graphics and text. To some extent, however, the applications of ink jet printing have been limited due to the demanding requirements the ink receptors must meet in order to provide high quality text and graphics.

A first factor affecting the image quality is the tendency of inks to "bleed". Bleeding refers to a phenomenon in which the edges, i.e., the boundaries of a printed area are blurred. Bleeding resistance is required when a large amount of ink is simultaneously applied to a receiving medium as when full color images are formed using multi-color inks since it is necessary that the ink be promptly absorbed without significantly blurring the edges of the multi-color printed area.

U.S. Pat. No. 5,133,803 reduces color bleed by employing high molecular weight colloids, such as alginates, in conjunction with amphoteric surfactants and/or non-ionic amphiphiles. The inks of the invention comprise a vehicle and a dye. The vehicle typically comprises a low viscosity, high boiling point solvent, one or two surfactants at concentrations above their critical micelle concentration (cmc), while the dye typically comprises any of the dyes commonly employed in ink-jet printing.

U.S. Pat. No. 4,781,985 discloses an ink-jet receiving transparency comprising a film support having a coating thereon, such coating containing one of two possible general structures of ionic fluorocarbon surfactants. One of these two general structures is characterized by a quaternary ammonium compound having a side chain containing a sulfide linkage; the other general structure contains the element phosphorus. It is disclosed that other fluorochemical surfactants will not provide the benefits of these two structures of exhibiting an improved ability to maintain the edge acuity of ink blocks on the transparency.

U.S. Pat. Nos. 5,688,603 and 5,707,722 describe an ink jet receiving sheet comprising, a) at least one nonionic fluorocarbon surfactant having a hydrophilic portion and a hydrophobic portion, b) at least one polymer selected from the group consisting of hydroxycellulose and substituted hydroxycellulose, and c) at least one phase separation additive or at least one alkanolamine metal chelate wherein said metal is selected from the group consisting of titanium, zirconium and aluminum. Such composition being crosslinkable when subjected to temperatures of at least about 90° C. and forming a microporous coating. High density images which are tack-free and permanent, and which have substantially no color bleed are obtained, while drying is very quickly.

U.S. Pat. No. 5,877,796 discloses a receiving sheet for ink-jet recording comprising a support and provided thereon, an ink receiving layer containing a binder, an anionic fluorine-containing surfactant and a cationic fluorine-containing surfactant to provide high and stable image quality.

Japanese Patent Application No. 8-104,055 discloses a receiving sheet for ink-jet recording comprising plastic film base having ink receiving layer comprising polyvinyl acetal resin, cationic fluorine-containing surfactant and nonionic fluorine-containing surfactant at least on its one side, the weight ratio of said compounds being determined according a detailed equation. The sheet has excellent ink receiving properties, water resistance, clarity of recorded images and durability of ink receiving layer. It also has good dot reproducibility and adhesion of its ink receiving layer.

Japanese Patent Application No. 3-286,895 discloses a receiving sheet for ink jet printing comprising a non-porous support and layer containing amorphous titanium dioxide and binder resin. In an example, a polyvinyl chloride sheet was coated with an aqeous dispersion composed of isopropanol, polyvinyl alcohol, amorphous titanium dioxide, high molecular anionic surfactant and fluorochemical nonionic surfactant and then dried to form an ink-absorptive receiving layer on the supporting film.

European Patent Application No. 761,460 describes an ink-jet sheet including a polymer composition laminated on a substrate. The polymer composition comprises 100 parts by weight of water-soluble polymer, 1.0 to 30 parts by weight of a polymer obtained from a monomer which is sparingly soluble in water and which has at least three ethylenically unsaturated groups in the molecule, and 0 to 20 parts by weight of fluorine-containing surfactant or silicon oil, giving good ink absorbability.

U.S. Pat. No. 5,580,372 discloses an ink composition for thermal ink-jet printing consisting of an aqueous solution, a co-solvent, a dye, a pH regulator, a viscosity modifier, a biocide and a mixture of three non-ionic surface-active agents, one of which is diethylene glycol mono-hexyl ether with high HLB, registering between 16 and 18, and the other two are fatty ethoxylate alcohols with a lower HLB, of between 10 and 14. This system of 3 surface-active agents produces surface tensions of between 25 and 45 dyne/cm, preferably between 25 and 38 dyne/cm and even more preferably between 28 and 34 dyne/cm.

Another problem is due to the glossiness, associated with the capacity of a surface to reflect more light in some directions than in others. The glossyness is related to the quantity of reflected light measured at a predetermined angle (generally at 20°, 60° or 85°) respect to incident light and expressed in percentage.

Japanese Patent Application No. 7-137,434 discloses an ink-jet receiving sheet mainly composed of organic particulates of the mean particle diameter of less than 0.1 millimicrons and binder and which contains nonionic surface active agent of more than HLB15 on the support. The ink-jet receiving sheet can have high gloss and good ink absorbency and dot reproductivity without cracking.

Another problem that exists in printing black/grey images is "mottle". Mottle is defined as the appearance of a spotty or uneven area fill in black/grey areas of out-put and is thought to result from the segregation of the colorant on the paper surface. This problem, which is paper or media dependant, leads to an unsightly or less than ideal image. Thus, there is a need for improved ink receptors that have minimum bleed, no mottle and good glossiness.

SUMMARY OF THE INVENTION

The ink jet receiving sheet of the invention comprises a support and at least two ink receiving layers, wherein the ink receiving layer farthest from the support comprises a first non-ionic surfactant having a dynamic surface tension lower than or equal to 27 dyne/$cm^2$, and in that the other ink receiving layer(s) comprise(s) a second non-ionic surfactant having a dynamic surface tension higher than or equal to 30 dyne/$cm^2$.

The ink jet receiving sheet of the invention provides minimum bleed, no mottle and good glossiness.

DETAILED DESCRIPTION OF THE INVENTION

The ink jet receiving sheet of the present invention comprises a support and at least two ink receiving layers coated on one or both side(s) of the support. When preparing an ink-jet receiving element according to this invention, by coating two or more ink-receiving layers onto a support, it is possible to prepare an ink-receiving element with excellent properties, especially with respect to ink bleeding and mottle.

The ink jet receiving sheet of the invention comprises a selective distribution of non-ionic surfactants having a specific value of dynamic surface tension. In particular, the ink receiving layer farthest from the support comprises a first non-ionic surfactant having a dynamic surface tension lower than or equal to 27 dyne/$cm^2$, and the other ink receiving layer(s) comprise(s) a second non-ionic surfactant having a dynamic surface tension higher than or equal to 30 dyne/$cm^2$. The above mentioned values of dynamic surface tension are measured in a 1% by weight water solution at 25° C.

Non-ionic surfactants having the above mentioned values of dynamic surface tension can be selected from non-ionic hydrocarbon surfactants and non-ionic fluorinated surfactants.

Useful examples of non-ionic hydrocarbon surfactants include ethers, such as polyoxyethylene nonyl phenyl ether, polyoxyethylene octyl phenyl ether, polyoxyethylene dodecyl phenyl ether, polyoxyethylene alkyl allyl ethers, polyoxyethylene oleyl ether, polyoxyethylene lauryl ether, polyoxyethylene alkyl ethers, polyoxyalkylene alkyl ethers; esters, such as polyoxyethylene oleate, polyoxyethylene distearate, sorbitan laurate, sorbitan monostearate, sorbitan monooleate, sorbitan sesquioleate, polyoxyethylene monooleate, and polyoxyethylene stearate; and glycol surfactants.

Specific examples of non-ionic hydrocarbon surfactants include octylphenoxy polyethoxy ethanols, such as Triton™ X-100, X-114, and X-405, available from Union Carbide Co., Danbury, Conn., acetylenic diols such as 2,4,7,9-tetramethyl-5-decyn-4,7-diol and the like, such as Surfynol™ GA and Surfynol™ CT-136, available from Air Products & Chemicals Co., Allentown, Pa., trimethyl nonylpolyethyleneglycol ethers, such as Tergitol™ TMN-10 (containing 10 oxyethylene units, believed to be of the formula $C_{12}H_{25}O(C_2H_4O)_5H$), available from Union Carbide Co., Danbury, Conn., non-ionic esters of ethylene oxide, such as Merpol™ SH (believed to be of the formula $CH_3(CH_2)_{12}(OC_2H_4)_8OH$), available from E. I. Du Pont de Nemours & Co., Wilmington, Del., non-ionic esters of ethylene oxide and propylene oxide, such as Merpol™ LFH (believed to be of the formula $CH_3(CH_2)n(OC_2H_4)_8(OC_3H_6)_8OH$, where n is an integer from about 12 to about 16), available from E. I. Du Pont de Nemours & Co., Wilmington, Del., and the like, as well as mixtures thereof.

Non-limiting examples of non-ionic fluorinated surfactants include linear perfluorinated polyethoxylated alcohols (e.g., Zonyl™FSN, Zonyl™FSN-100, Zonyl™FSO, and Zonyl™FSO-100 available from DuPont Specialty Chemicals, Wilmington, Del.), fluorinated alkyl polyoxyethylene ethanols (e.g., Fluorad™ FC-170C available from 3M, St. Paul, Minn.), fluorinated alkyl alkoxylate (e.g., Fluorad™ FC-171 available from 3M, St. Paul, Minn.), fluorinated alkyl esters (e.g., Fluorad™ FC-430, FC-431, and FC-740 available from 3M, St. Paul, Minn.) and fluorine-substituted alkyl esters and perfluoroalkyl carboxylates (for example, Ftergent series manufactured by Neos Co., Ltd., Lodyne series manufactured by Ciba-Geigy, Monflor series manufactured by ICI, Surfluon series manufactured by Asahi Glass Co., Ltd., and Unidyne series manufactured by Daikin Industries, Ltd.). Preferred nonionic fluorocarbon surfactants include Zonyl™ FSO, Fluorad™ FC-170C, and Fluorad™ FC-171.

The above-described non-ionic surfactants ordinarily make up from 1 to 20 weight % and preferably from 2 to 10 weight % based on the solid content of the ink receiving layer compositions. The coating composition of each ink receiving layer preferably comprises a non-ionic surfactant amount of from 0.1 to 10 weight % and preferably from 0.5 to 5 weight % based on the solid content of the ink receiving layer composition. Accordingly, the resulting ink receiving layers totally comprise a non-ionic surfactants amount of from 0.01 to 1 g/$m^2$, preferably from 0.05 to 0.50 g/$m^2$. Each ink receiving layer preferably comprises a non-ionic surfactant amount of from 0.01 to 0.50 g/$m^2$, preferably from 0.05 to 0.30 g/$m^2$.

The support used in the ink jet receiving sheet of the invention includes any conventional support for ink jet receiving sheet. A transparent or opaque support can be used according to the final use of the ink jet receiving sheet. Useful examples of transparent support include films of polyester resins, cellulose acetate resins, acryl resins, polycarbonate resins, polyvinyl chloride resins, poly(vinylacetal) resins, polyether resins, polysulfonamide resins, polyamide resins, polyimide resins, cellophane or celluloid and a glass plate. The thickness of the transparent support is preferably from 10 to 200 $\mu$m. Useful examples of opaque support include paper, coat paper, synthetic paper, resin-covered paper, pigment-containing opaque film or foaming film, but synthetic paper, a resin-covered paper or various films are preferable in view of glossiness or smoothness, and resin-covered paper or polyester film are preferable in view of touchiness or luxuriousness.

The base paper constituting the resin-covered paper useful in the invention is not specifically limited, and any conventional paper can be used, but a smooth paper used as a conventional photographic support is preferable. The pulp used for the preparation of the base paper, singly or in admixture, is constituted by natural pulp, reproduction pulp, chemical pulps such as hardwood bleached kraft pulp, softwood bleached kraft pulp, high yield pulps such as groundwood pulp or thermo-mechanical pulp, recycled pulps and non-wood pulps such as cotton pulp or synthetic pulp. These base papers may contain additives usually employed in paper manufacture such as a sizing agent, binders, fixing agents, yield-improving agents, cationated agents, paper stiffness enhancing agents, reinforcing agents, fillers, anti-static agents, fluorescent brightening agents or dyes. A surface sizing agent, a surface reinforcing agent, a fluorescent brightening agent, an antistatic agent and an anchoring agent may be coated on the surface of the material.

The thickness of the base paper is not specifically limited, but is preferably from 10 to 200 $\mu$m. A base paper having a smooth surface is preferable, which is obtained by applying pressure to or calendering, paper, during or after papering. The weight of the base paper is preferably from 30 to 250 g/m$^2$. The resin used in the manufacturing of resin-covered paper is preferably a polyolefin resin or a resin capable of being hardened with an electron beam. The polyolefin resin includes an olefin homopolymer such as a low density polyethylene, a high density polyethylene, polypropylene or polypentene, an olefin copolymer such as ethylene-propylene copolymer or their mixture, each having various densities or melt viscosity indexes (melt index). These resins can be used singly or in combination.

The resin for the resin-covered paper preferably contains various additives, for example, white pigment such as titanium oxide, zinc oxide, talc or calcium carbonate, a fatty acid amide such as stearic acid amide or arachidic acid amide, a fatty acid metal salt such as zinc stearate, calcium stearate, aluminum stearate or magnesium stearate, an antioxidant such as Irganox™1010 or Irganox™1076, blue pigment or dyes such as cobalt blue, ultramarine, or phthalocyanine blue, magenta pigment or dyes such as cobalt violet, fast violet or manganese violet, a brightening agent and a UV absorber. These additives can be suitably used in combination.

The resin-covered paper, which is the support preferably used in the present. invention, is manufactured by a so-called extrusion method casting a thermally fused resin (for example, fused polyolefin) on the moving paper, whereby both surfaces of the paper are covered with the resin. When the paper is covered with a resin capable of being hardened with electron beam irradiation, the resin is coated with a conventional coater such as a gravure coater or a blade coater and then is irradiated with electron beam to harden the coated resin. Before the paper is coated with a resin, the surface of the paper is preferably subjected to activation treatment such as corona discharge treatment or flame treatment. The surface of the support on the ink receiving layer side is glossy or matted depending upon its usage, and glossy surface is preferable. The back side of the support is not necessarily covered with a resin, but is preferably covered with a resin in view of prevention of curling. The back surface of a support is ordinarily non-glossy, but the back surface or both surfaces of the support are optionally subjected to activation treatment such as corona discharge treatment or flame treatment. The thickness of a covered resin is not specifically limited, but is ordinarily from 5 to 50 $\mu$m.

A subbing or primer layer to improve the adhesion between the film support and the ink receiving layer(s) may be provided. Useful subbing layers for this purpose are widely known in the photographic art and include, for example, polymers of vinylidene chloride such as vinylidene chloride/acrylonitrile/acrylic acid terpolymers or vinylidene chloride/methyl acrylate/itaconic acid terpolymers.

The ink receiving layers of the ink jet receiving sheet of the present invention are obtained by coating on the support different coating compositions comprising the above mentioned surfactants, as well as other adjuvants dispersed in a binder. Useful additional adjuvants are represented by fillers, mordants, matting agents, hardeners, plasticizer, and the like.

The binder includes any useful hydrophilic polimer, either natural or syntetic. Useful hydrophilic polymers include polyvinyl alcohol, polyvinyl acetate, acidified starch, ethered starch, polyalkylene glycols (such as polyethylene glycol and polypropylene glycol), cellulose derivatives (such as hydroxyethyl cellulose, hydroxypropyl cellulose, hydroxyethylmethyl cellulose, hydroxypropylmethyl cellulose, hydroxybutylmethyl cellulose, methyl cellulose, sodium carboxymethyl cellulose, sodium carboxymethylhydroxethyl cellulose, water soluble ethylhydroxyethyl cellulose, cellulose sulfate), polyvinylpyrolidone, gelatin, carrageenan, dextran, dextrin, gum arabic, casein, pectin, albumin, collagen derivatives, collodion, agar-agar, maleic acid resin, coniugate diene copolymer latexes such as styrene-butadiene resin and methylmethacrylate-butadiene copolymer and acryl copolymer latexes such as a polymer or copolymer of acrylic acid ester and methacrylic acid ester; vinyl copolymer latexes such as ethylene vinyl acetic acid copolymer; and synthetic resin binders such as polymethylmethacrylate, polyurethane resin, unsaturated polyester resin, vinyl chloride-vinyl acetic acid copolymer, polyvinyl acetal resins and alkyl resins are cited. These resins may be used independently or two or more thereof maybe used in combination.

Preferred binders are gelatin, polyvinylpyrrolidone and polyvinylalcohol or binary or ternary blends of these. Gelatin is a particularly preferred material for use in forming the ink receiving layer according to this invention. Among the reasons is the fact that it forms a clear coating, is readily cross-linked in an easily controllable manner, and is highly absorptive of water-based liquid inks to thereby provide rapid-drying characteristics.

As gelatin, any gelatin made from animal collagen can be used, but gelatin made from pig skin, cow skin or cow bone collagen is preferable. The kind of gelatin is not specifically limited, but lime-processed gelatin, acid processed gelatin, amino group inactivating gelatin (such as acetylated gelatin, phthaloylated gelatin, malenoylated gelatin, benzoylated gelatin, succinoylated gelatin, methyl urea gelatin, phenylcarbamoylated gelatin, and carboxy modified gelatin), or gelatin derivatives (for example, gelatin derivatives disclosed in Japanese Patent Publication Nos. 38-4854/1962, 39-5514/1964, 40-12237/1965, 42-26345/1967 and 2-13595/1990, U.S. Pat. Nos. 2,525,753, 2,594,293, 2,614,928, 2,763,639, 3,118,766, 3,132,945, 3,186,846 and 3,312,553 and British Patent Nos. 861,414 and 103,189) can be used singly or in combination.

The binder resins ordinarily make up from 30 to 90 weight % and preferably 50 to 80 weight % based on the solid content of the ink receiving layer compositions. Preferably, the ink receiving layers totally comprise a binder amount of from 1 to 20 g/m$^2$, and more preferably from 2 to 10 g/m$^2$.

According to a preferred aspect of the present invention, the ink receiving layer may, also contain a glossiness improving agent represented by monosaccharides and/or oligosaccharides and/or polysaccharides having a recurring unit comprising five or six carbon atoms. Said saccharides can be hydrogenated or non-hydrogenated. Preferred recurring units include, for example, glucose, xylose, mannose, arabinose, galactose, sorbose, fructose, fucose, adonitol, arbitol, inositol, xylitol, dulcitol, iditol, lactitol, mannitol, sorbitol, and the like. The average molecular weight of said saccharides ranges from 1,000 to 500,000, preferably from 1,000 to 30,000.

Hydrogenated and non-hydrogenated saccharides useful in the present invention are commercially available, for example, under the trade designation POLYSORB™ or GLUCIDEX™, from Roquette, Lille, France. The preparation of hydrogenated and non-hydrogenated oligosaccharides usually starts from natural products (like starch, agar, tragacanth gum, xanthan gum, guar gum, and the like) by means of enzymatic processes (to reduce the average molecular weight) and of reducing processes (to saturate the molecule, in case of hydrogenated saccharides).

The above-described glossiness improving agent ordinarily make up to 30 weight % and preferably up to 20 weight % based on the solid content of the ink receiving layer compositions. Preferably, the resulting ink receiving layers totally comprise a glossiness improving agent amount of from 0.1 to 5 $g/m^2$, and more preferably from 0.5 to 3 $g/m^2$.

As filler, inorganic and/or organic particles can be used. Useful examples of inorganic fillers are represented by silica (colloidal silica), alumina or alumina hydrate (aluminazol, colloidal alumina, a cation aluminum oxide or its hydrate and pseudo-boehmite), a surface-processed cation colloidal silica, aluminum silicate, magnesium silicate, magnesium carbonate, titanium dioxide, zinc oxide, calcium carbonate, kaoline, talc, clay, calcium sulfate, barrium sulfate, zinc sulfate, zinc carbonate, satin white, diatomaceous earth, synthetic amorphous silica, aluminum hydroxide, lithopone, zeolite, magnesium hydroxide and synthetic mica. Of these inorganic pigments, porous inorganic pigments are preferable such as porous synthetic crystalloid silica, porous calcium carbonate and porous alumina.

Useful examples of organic fillers are represented by polystyrene, polymethacrylate, polymethyl-methacrylate, elastomers, ethylene-vinyl acetate copolymers, polyesters, polyester-copolymers, polyacrylates, polyvinylethers, polyamides, polyolefines, polysilicones, guanamine resins, polytetrafluoroethylene, elastomeric styrene-butadiene rubber (SBR), elastomeric butadiene-acrylonitrile rubber (NBR), urea resins, urea-formalin resins. Such organic fillers may by used in combination, and/or in place of the above-mentioned inorganic fillers.

The above-described inorganic and/or organic fillers ordinarily make up to 20 weight % and preferably up to 10 weight % based on the solid content of the ink receiving layer compositions. Preferably, the resulting ink receiving layers totally comprise a filler amount of from 0.1 to 5 $g/m^2$, preferably from 0.2 to 3 $g/m^2$, most preferably from 0.3 to 1 $g/m^2$.

In addition to the non-ionic surfactants used in the present invention, additional surfactants, such as anionic surfactants, amphoteric surfactants and cationic surfactants can be used. Examples of the anionic surfactant include alkylsulfocarboxylates, α-olefin sulfonates, polyoxyethylene alkyl ether acetates, N-acyl amino acid and salts thereof, N-acyl methyltaurine salts, alkylsulfate polyoxy alkyl ether sulfates, alkylsulfate polyoxyethylene alkyl ether phosphates, rosin soap, castor oil sulfate, lauryl alcohol sulfate, alkylphenol phosphates, alkyl phosphates, alkyl allyl sulfonates, diethylsulfosuccinate, diethylhexylsulfosuccinate, and dioctylsulfosuccinate. Examples of the amphoteric surfactant include lauryl dimethyl aminoacetic acid betaine, 2-alkyl-N-carboxymethyl-N-hydroxyethyl imidazolinium betaine, propyldimethylaminoacetic acid betaine, polyoctyl polyaminoethyl glycine, and imidazoline derivatives. Examples of the cationic surfactant include 2-vinylpyridine derivatives and poly-4-vinylpyridine derivatives.

Mordants may be incorporated in the ink-receptive layer of the present invention. Such mordants are represented by cationic compounds, monomeric or polymeric, capable of complexing with the dyes used in the ink compositions. Useful examples of such mordants include quaternary ammonium block copolymers, such as Mirapol A-15 and MirapoL WT available from Miranol Incorporated, Dayton, N.J., prepared as disclosed in U.S. Pat. No. 4,157,388, Mirapol AZ-1 available from Miranol Inc., prepared as disclosed in U.S. Pat. No. 4,719,282, Mirapol AD-1 available from Miranol Inc., prepared as disclosed in U.S. Pat. No. 4,157,388, Mirapol 9, Mirapol 95, and Mirapol 175 available from Miranol Inc., prepared as disclosed in U.S. Pat. No. 4,719,282, and the like. Other suitable mordants comprise diamino alkanes, ammonium quaternary salts (such as poly(vinylbenzyl quaternary ammonium salts disclosed in U.S. Pat. No. 4,794,067), and quaternary acrylic copolymer latexes.

Other suitable mordants are fluoro compounds, such as tetra ammonium fluoride hydrate, 2,2,2-trifluoroethylamine hydrochloride (Aldrich #18,038-6); 2,2,2-trifluoroethyltoluene sulfonate (Aldrich #17,782-2); 1-(α,α,α-trifluoro-m-tolyl) piperazine hydrochloride, 4-bromo-α,α,α-trifluoro-o-toluidine hydrochloride, difluorophenylhydrazine hydrochloride, 4-fluorobenzylamine hydrochloride, 4-fluoro-α,α-dimethylphenethylamine hydrochloride, 2-fluoroethylaminehydrochloride, 2-fluoro-1-methyl pyridinium-toluene sulfonate, 4-fluorophenethylamine hydrochloride, fluorophenylhydrazine hydrochloride, 1-(2-fluorophenyl) piperazine monohydrochloride, 1-fluoro pyridinium trifluoromethane sulfonate.

Further mordants are monoammonium compounds as disclosed in, for example, U.S. Pat. No. 5,320,902, including (A) tetradecyl ammonium bromide (Fluka 87582), tetradodecyl ammonium bromide (Fluka 87249), tetrahexadecyl ammonium bromide (Fluka 87298), tetraoctadecyl ammonium bromide (Aldrich 35,873-8), and the like; (B) 2-coco trimethyl ammonium chloride (Arquad C-33, C-33W, C-50 from Akzo Chemie), palmityl trimethyl ammonium chloride (Adogen 444 from Sherex Chemicals), myristyl trimethyl ammonium bromide (Cetrimide BP Triple Crown America), benzyl tetradecyl dimethyl ammonium chloride (Arquad DM 14B-90 from Akzo Chemie), didecyl dimethyl ammonium bromide (Aldrich 29,801-8), dicetyl dimethyl ammonium chloride (Adogen 432CG, Sherex Chemicals), distearyl dimethyl ammonium methyl sulfate (Varisoft 137, 190-100P from Sherex Chemicals, Arosurf TA-100 from Sherex Chemicals), difatty acid isopropyl ester dimethyl ammonium methyl sulfate (Rewoquat CR 3099 from Rewo Quimica, Loraquat CR 3099 from Dutton and Reinisch), tallow dimethyl trimethyl propylene diammonium chloride (Tomah Q-D-T from Tomah), and N-cetyl, N-ethyl morpholinium ethosulfate (G-263 from ICI Americas).

Additional mordants are phosphonium compounds, such as, for example, those disclosed in U.S. Pat. No. 5,766,809, including bromomethyl triphenyl phosphonium bromide (Aldrich 26,915-8), 3-hydroxy-2-methyl propyl triphenyl phosphonium bromide (Aldrich 32,507-4), 2-tetraphenyl phosphonium bromide (Aldrich 21,878-2), tetraphenyl phosphonium chloride (Aldrich 21879-0), hexadecyl tributyl phosphonium bromide (Aldrich 27,620-0), and stearyl tributyl phosphonium bromide (Aldrich 29,303-2).

Additional examples of mordants include those disclosed in U.S. Pat. Nos. 5,760,809, 5,457,486, 5,314,747, 5,320,902, and 5,441,795.

The ink receiving layer can be hardened with a hardener in order to improve water resistance or dot reproduction. Examples of the hardener include aldehyde compounds such as formaldehyde and glutaraldehyde, ketone compounds such as diacetyl and chloropentanedion, bis(2-chloroethylurea), 2-hydroxy-4,6-dichloro-1,3,5-triazine, reactive halogen-containing compounds disclosed U.S. Pat. No. 3,288,775, carbamoyl pyridinium compounds in which the pyridine ring carries a sulfo or sulfoalkyl group disclosed in U.S. Pat. Nos. 4,063,952 and 5,529,892, divinylsulfones, reactive olefin-containing compounds disclosed U.S. Pat. No. 3,635,718, N-methylol compounds disclosed U.S. Pat. No. 2,732,316, isocyanates disclosed U.S. Pat. No. 3,103,437, aziridine compounds disclosed U.S. Pat. Nos. 3,017,280 and 2,983,611, carbodiimides disclosed U.S. Pat. No. 3,100,704, epoxy compounds disclosed U.S. Pat. No. 3,091,537, halogencarboxyaldehydes such as mucochloric acid, dioxane derivatives such as dihydroxy dioxane, and inorganic hardeners such as chromium alum, potash alum and zirconium sulfate. These hardeners can be used singly or in combination. The addition amount of hardener is preferably from 0.05 to 5 weight %, and more preferably 0.1 to 1 weight % based on the solid content of the ink receiving layer compositions.

The ink receiving layer may contain a matting agent in an amount of 0.005 to 0.3 g/m$^2$ in order to prevent adhesion defect such as blocking. The matting agent can be defined as particles of inorganic or organic materials capable of being discontinuously dispersed in a hydrophilic organic colloid. The inorganic matting agents include oxides such as silicon oxide, titanium oxide, magnesium oxide and aluminum oxide, alkali earth metal salts such as barium sulfate, calcium carbonate, and magnesium sulfate, light-insensitive silver halide particles such as silver chloride and silver bromide (each of which may contain a small amount of an iodine atom), and glass particles. Besides these substances are used inorganic matting agents which are disclosed in West German Patent No. 2,529,321, British Patent Nos. 760,775 and 1,260,772, U.S. Pat. Nos. 1,201,905, 2,192,241, 3,053,662, 3,062,649, 3,257,296, 3,322.555, 3,353,958, 3,370,951, 3,411,907, 3,437,484, 3,.523,022, 3,615,554, 3,635,714, 3,769,020, 4,021,245 and 4,029,504. The organic matting agents include starch, cellulose esters such as cellulose acetate propionate, cellulose ethers such as ethyl cellulose, and synthetic resins. The synthetic resins are water insoluble or sparingly soluble polymers which include a polymer of an alkyl(meth)acrylate, an alkoxyalkyl(meth) acrylate, a glycidyl(meth)acrylate, a (meth)acrylamide, a vinyl ester such as vinyl acetate, acrylonitrile, an olefin such as ethylene, or styrene and a copolymer of the above described monomer with other monomers such as acrylic acid, methacrylic acid, α,β-unsaturated dicarboxylic acid, hydroxyalkyl(meth)acrylate, sulfoalkyl(meth)acrylate and styrene sulfonic acid. Further, a benzoguanamin-formaldehyde resin, an epoxy resin, nylon, polycarbonates, phenol resins, polyvinyl carbazol or polyvinylidene chloride can be used. Besides the above are used organic matting agents which are disclosed in British Patent No. 1,055,713, U.S. Pat. Nos. 1,939,213, 2,221,873, 2,268,662, 2,322,037, 2,376,005, 2,391,181, 2,701,245, 2,992,101, 3,079,257, 3,262,782, 3,443,946, 3,516,832, 3,539,344,554, 3,591,379, 3,754,924 and 3,767,448, Japanese Patent O.P.I. Publication Nos. 49-106821/1974 and 57-14835/1982. These matting agents may be used in combination.

The ink-receiving layer of the present invention can also comprise a plasticizer such as ethylene glycol, dietylene glycol, propylene glycol, polyethylene glycol, glycerol monomethylether, glycerol monochlorohydrin, ethylene carbonate, propylene carbonate, tetrachlorophthalic anhydride, tetrabromophthalicanhydride, urea phosphate, triphenylphosphate, glycerolmonostearate, propylene glycol monostearate, tetramethylene sulfone, n-methyl-2-pyrrolidone, n-vinyl-2-pyrrolidone, and polymer latices with low Tg-value such as polyethylacrylate, polymethylacrylate, etc.

The ink receiving layer can comprise biocides. Examples of suitable biocides include (A) nonionic biocides, such as 2-bromo-4'-hydroxyacetophenone (Busan 90 available from Buckman Laboratories); 3,5-dimethyl tetrahydro-2H-1, 3,5-thiadiazine-2-thione (Slime-Trol RX-28 available from Betz Paper Chem Inc.); a nonionic blend of 5-chloro-2-methyl-4-isothiazoline-3-one, 75 percent by weight, and 2-methyl-4-isothiazolin-3-one, 25 percent by weight (available as Amerstat 250 from Drew Industrial Division; Nalcon 7647 from Nalco Chemical Company; Kathon LX from Rohm and Haas Company); and the like, as well as mixtures thereof; (B) anionic biocides, such as anionic potassium N-hydroxymethyl-N-methyl-dithiocarbamate (available as Busan 40 from Buckman Laboratories Inc.); an anionic blend of methylene bis-thiocyanate, 33 percent by weight, sodium dimethyl-dithiocarbamate, 33 percent by weight, and sodium ethylene bisdithiocarbamate, 33 percent by weight, (available as Amerstat 282 from Drew Industrial Division; AMA-131 from Vinings Chemical Company); sodium dichlorophene (G-4-40 available from Givaudan Corporation); and the like, as well as mixtures thereof; (C) cationic biocides, such as cationic poly(oxyethylene (dimethylamino)ethylene (dimethylamino) ethylene dichloride) (Busan 77 available from Buckman Laboratories Inc.); a cationic blend of bis(trichloromethyl) sulfone and a quaternary ammonium chloride (available as Slime-Trol RX-36 DPB865 from Betz Paper Chem. Inc.); and the like, as well as mixtures thereof. The biocide can be present in any effective amount; typically, the biocide is present in an amount of from 0.1 percent by weight to 3 percent by weight of the coating, although the amount can be outside this range.

The ink receiving layer in the invention may further contain various conventional additives such as colorants, colored pigments, pigment dispersants, mold lubricants, permeating agents, fixing agents for ink dyes, UV absorbers, anti-oxidants, dispersing agents, anti-foaming agents, leveling agents, fluidity improving agents, antiseptic agents, brightening agents, viscosity stabilizing and/or enhancing agents, pH adjusting agents, anti-mildew agents, anti-fungal agents, agents for moisture-proofing, agents for increasing the stiffness of wet paper, agents for increasing the stiffness of dry paper and anti-static agents.

The above-mentioned various additives can be added ordinarily in a range of 0 to 10 weight % based on the solid content of the ink receiving layer composition.

As a coating method of an ink receiving layer coating solution, any conventional coating method (for example, a curtain method, an extrusion method, an air-knife method, a slide coating, a roll coating method, reverse roll coating, solvent extrusion, dip coating processes and a rod bar coating method) can be used.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLES

Example 1

Sample 1 (Reference)

A receiving ink jet sheet was prepared using a support comprising a paper base having a weight of 170 g/m$^2$ in which a resin part having a weight of 25 g/m$^2$ of low density polyethylene is coated on both the two sides. A gelatin primer was coated on the front side and an anti curl gelatin layer was coated on the back side.

Three different coating solutions were coated at once with an extrusion system at 10.6 meter per minute on the front side of the aforementioned support.

The resulting coating was dried to give a multilayer inkjet receiving sheet with the following composition:

First layer: 3.60 g/m$^2$ of gelatin;

Second layer: 3.60 g/m$^2$ of gelatin, and 0.54 g/m$^2$ of fines particles of aluminum oxide;

Third layer: 0.77 g/m$^2$ of gelatin, 0.05 g/m$^2$ of polymethylmethacrylate beads, and 0.07 g/m$^2$ of cross-linking agent H-1.

Sample 2 (Reference)

The procedure of sample 1 was repeated with the same process, except that the three coating solutions comprised an amount of Zonyl™ FSN 100, a non-ionic fluorinated surfactant, to obtain a coverage of 0.05 g/m$^2$ in the resulting first layer, 0.11 g/m$^2$ in the resulting second layer and 0.08 g/m$^2$ in the resulting third layer.

Sample 3 (Reference)

The procedure of sample 1 was repeated with the same process, except that the three coating solutions comprised an amount of Triton™ X-100, a non ionic surfactant, to obtain a coverage of 0.05 g/m$^2$ in the resulting first layer, 0.11 g/m$^2$ in the resulting second layer and 0.08 g/m$^2$ in the resulting third layer.

Sample 4 (Invention)

The procedure of sample 1 was repeated with the same process, except that the first and second layer coating solutions comprised an amount of Triton™ X-100, a non ionic surfactant, to obtain a coverage of 0.05 g/m$^2$ in the resulting first layer, and 0.11 g/m$^2$ in the resulting second layer and the third layer coating solution comprised an amount of Zonyl™ FSN 100, a non-ionic fluorinated surfactant, to obtain a coverage of 0.08 g/m$^2$ in the resulting third layer.

Sample 5 (invention) was obtained as Sample 4, but the amount of Zonyl™ FSN 100 non-ionic fluorinated surfactant in the resulting third layer was such to obtain a coverage of 0.16 g/m$^2$.

An evaluation image pattern is recorded on samples 1 to 5 using an HP Desk-jet 870 Cxi ink jet printer (produced by Hewlett Packard), and a Stylus color ink jet printer (produced by Epson). The black density was generated using carbon black in case of HP printer, and using dye in case of Epson printer, but in both case the ink was uniformly jetted at maximum ink jetting amount possibility of each printer. The obtained imaged samples were submitted to bleeding and mottle evaluation.

The bleeding test was performed by printing a multiple row pattern of various different colors and visualing evaluating the inter-diffusion of colors.

The mottle test was performed by visual inspection of the samples. Samples which show "banding" in addition to mottling are considered even more objectionable. Banding is defined as dark bands of ink between print swaths.

The results are summarized in the following Table 1. For each evaluation, a ranking score was given wherein A means "Image quality perfect", B means "Some defect observed but not practical problem in Image quality", C means "Defect observed that can produce problem in Image quality", and D means "Defect observed that give unacceptable problem in Image quality".

TABLE 1

| Ex. | Third layer | Second layer | First layer | Bleeding | Mottle | Black HP |
|---|---|---|---|---|---|---|
| 1 (Ref.) | — | — | — | A/B | C | D |
| 2 (Ref.) | Zonyl ™ FSN100 (0.08 g) | Zonyl ™ FSN100 (0.11 g) | Zonyl ™ FSN100 (0.05 g) | C/D | A | A |
| 3 (Ref.) | Triton ™ X100 (0.08 g) | Triton ™X100 (0.11 g) | Triton ™ X100 (0.05 g) | A | D | D |
| 4 (Inv.) | Zonyl ™ FSN100 (0.08 g) | Triton ™X100 (0.11 g) | Triton ™ X100 (0.05 g) | A/B | A/B | A |
| 5 (Inv.) | Zonyl ™ FSN100 (0.16 g) | Triton ™X100 (0.11g) | Triton ™ X100 (0.05 g) | A/B | A | A |

Reference sample 2 comprising, in all layers, Zonyl™ FSN 100, a non ionic fluorinated surfactant that promotes the ink spread on layer surface, exhibited an improved carbon black covering and an improved mottle level. However, the presence of Zonyl™ FSN 100 which also promotes lateral diffusion inside the layers, resulted in an unacceptable bleeding.

Reference sample 3 comprising, in all layers, Triton™ X-100, a non ionic hydrocarbonated surfactant which restrains ink diffusion inside the layer, exhibited an improved bleeding level. However, the absence of spreading promoting agent gave rise to a very high mottle level and a poor carbon black covering.

Sample 4 of the invention, comprising a combination of the two surfactant types selectively distributed, that is, the spreading promoting agent (Zonyl™ FSN 100) in top layer and the ink diffusion restrainer (Triton™ X-100) in the other sub layers, exhibited an improved carbon black covering and an improved mottle level without deteriorating bleeding performances.

Sample 5 of the invention, comprising the same surfactant combination of sample 4, but comprising a higher amount of Zonyl™ FSN 100 in the top layer, exhibited an further improved mottle level maintaining good performances for carbon black covering and bleeding.

Accordingly, the selective combination of two surfactant types, one which promote spreading on top layer surface with another which restrain ink diffusion inside the sub layer, allow to improve the pigment covering level on surface of inkjet receiving sheet, to remove mottle defects and to maintain a low bleeding level given at final a good image quality.

Example 2

Samples 6–9 (Invention)

The procedure of sample 4, employed as reference sample, was repeated with the same process, except that the three coating solutions comprised an amount of different polysaccharides according to the following Table 2 to obtain a coverage of 0.57 g/m$^2$ in the resulting first layer, 0.56 g/m$^2$ in the resulting second layer and 0.13 g/m$^2$ in the resulting third layer. The glossiness was measured on unprinted samples 6–9 at 60° C. with a TRI-Microgloss-160 (Produced by Sheen), as disclosed in ASTM standard No. 523. The results are summarized in the following Table 2.

TABLE 2

| Ex. | Polysaccharide | I Layer g/m$^2$ | II Layer g/m$^2$ | III Layer g/m$^2$ | Glossiness 60° |
|---|---|---|---|---|---|
| 4 (Ref.) | — | — | — | — | 79.1 |
| 6 (Inv.) | Glucidex-2 ™ | 0.57 | 0.56 | 0.13 | 88.3 |
| 7 (Inv.) | Glucidex-6 ™ | 0.57 | 0.56 | 0.13 | 89.7 |
| 8 (Inv.) | Glucidex-12 ™ | 0.57 | 0.56 | 0.13 | 89.8 |
| 9 (Inv.) | Glucidex-19 ™ | 0.57 | 0.56 | 0.13 | 86.8 |

The data of Table 2 clearly show that the introduction of polysaccharides into the ink-jet receiving sheet of the invention allows to obtain a better value of glossiness. The good results of bleeding and mottle were not negatively affected by such saccharides.

Triton™ X-100 is the trade name of a non-ionic surfactant of the alkylphenoxyethylene type having a dynamic surface tension of 32 dyne/cm$^2$, a HLB value of 13.5 and corresponding to the following formula:

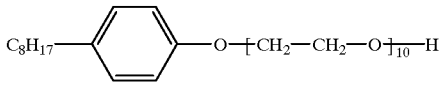

Zonyl™ FSN 100 is the trade name of a non-ionic surfactant of the perfluoroalkylpolyoxyethylene type, manufactured by DuPont having a dynamic surface tension of 26 dyne/cm$^2$, a HLB value in the range 10–13 and corresponding to the following formula:

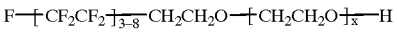

Cross-linking agent H-1 is a pyridinium derivative having the following formula:

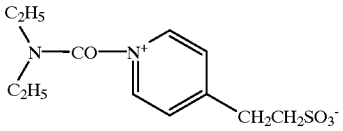

Glucidex-2™, Glucidex-6™, Glucidex-12™ and Glucidex-19™ are the trade names of polysaccharides available from Roquette Freres S.A., Lille, France.

What is claimed is:

1. An ink jet receiving sheet comprising a support and at least two ink receiving layers, characterized in that the ink receiving layer farthest from the support comprises a first non-ionic surfactant having a dynamic surface tension lower than or equal to 27 dyne/cm$^2$, and the other ink receiving layer(s) comprises a second non-ionic surfactant having a dynamic surface tension higher than or equal to 30 dyne/cm$^2$.

2. The ink jet receiving sheet according to claim 1, characterized in that said first and second non-ionic surfactants are selected from the class consisting of non-ionic hydrocarbon surfactant and non-ionic fluorinated surfactant.

3. The ink jet receiving sheet according to claim 2, characterized in that said non-ionic hydrocarbon surfactant is selected from the group consisting of ether surfactants, ester surfactants, acetylene glycol surfactants, octylphenoxy polyethoxy ethanols, acetylenic diols, trimethyl nonylpolyethylene-glycol ethers, non-ionic esters of ethylene oxide, and non-ionic esters of ethylene oxide and propylene oxide.

4. The ink jet receiving sheet according to claim 2, characterized in that said non-ionic fluorinated surfactant is selected from the group consisting of perfluorinated polyethoxylated alcohols, fluorinated alkyl polyoxyethylene ethanols, fluorinated alkyl alkoxylate, fluorinated alkyl esters, and fluorine-substituted alkyl esters and perfluoroalkyl carboxylates.

5. The ink jet receiving sheet according to claim 1, characterized in that the total surfactant content of said at least two ink receiving layers ranges from 0.01 to 1 g/m$^2$.

6. The ink jet receiving sheet according to claim 1, characterized in that the surfactant content of each ink receiving layer ranges from 0.01 to 0.50 g/m$^2$.

7. The ink jet receiving sheet according to claim 1, characterized in that said at least two ink receiving layers comprise a glossiness improving agent selected from the group consisting of mono-, oligo-, or poly-saccharides.

8. The ink jet receiving sheet according to claim 7, characterized in that said mono-, oligo-, or poly-saccharides comprises a recurring unit selected from the group consisting of glucose, xylose, mannose, arabinose, galactose, sorbose, fructose, fucose, adonitol, arbitol, inositol, xylitol, dulcitol, iditol, lactitol, mannitol, sorbitol, and a combination thereof.

9. The ink jet receiving sheet according to claim 7, characterized in that the total glossiness improving agent content of said at least two ink receiving layers ranges from 0.1 to 5 g/m$^2$.

* * * * *